United States Patent [19]

Allen et al.

[11] 4,372,633

[45] Feb. 8, 1983

[54] HIGH CURRENT TRANSFER ROLL RING ASSEMBLY

[75] Inventors: Terry S. Allen; Peter E. Jacobson, both of Phoenix, Ariz.

[73] Assignee: Sperry Corporation, New York, N.Y.

[21] Appl. No.: 255,021

[22] Filed: Apr. 17, 1981

[51] Int. Cl.[3] ..... H01R 39/28

[52] U.S. Cl. ..... 339/5 M; 310/232

[58] Field of Search ..... 339/5, 94; 310/242, 310/239, 232

[56] References Cited

U.S. PATENT DOCUMENTS

| | | | |
|---|---|---|---|
| 2,409,600 | 10/1946 | Trautschold | 339/5 S |
| 3,489,982 | 1/1970 | Dauphinee | 339/5 R |
| 4,068,909 | 1/1978 | Jacobson et al. | 339/5 R |
| 4,098,546 | 7/1978 | Swartz et al. | 339/5 R |

*Primary Examiner*—Eugene F. Desmond

*Attorney, Agent, or Firm*—Howard P. Terry

[57] ABSTRACT

A full rotational, substantially zero friction electrical conductor assembly conducts relatively high electrical currents between a pair of relatively rotatable members. Electrical conductor modules are axially stacked to provide multiple circuit capabilities wherein each module has a pair of electrical conductive rings affixed to the rotatable members defining an annular radial gap therebetween. A plurality of resilient filamentary conductor loops are disposed between these conductive rings, and the loops contact, roll on, and are captured by the conductive rings thereby providing electrical continuity between the relatively rotatable members. Loop separating spools are interspaced between and in rolling contact with the conductor loops to prevent the loops from touching one another and generating frictional losses. A circular raceway, carried by one of the rotatable members, keeps the spools in rolling alignment with the loops.

13 Claims, 4 Drawing Figures

HIGH CURRENT TRANSFER ROLL RING ASSEMBLY

BACKGROUND OF THE INVENTION

1. Field of the Invention

The present invention relates generally to improvements in the electrical current transfer device for transferring electrical current between relatively rotatable members, the broad class of such devices generally being referred to as slip rings. Specifically, the invention relates to an improved current transfer device for conducting heavy currents between stator and rotor members, such as between the relatively rotatable members of a solar panel pointing device utilized in aerospace applications, or for conducting power supply currents between spun and despun sections of a spin stabilized satellite, while having relatively low friction torque from the current transfer device.

2. Description of the Prior Art

Rolling electrical conductor assemblies are not broadly new and have heretofore been proposed for use in place of the more conventional slip ring and brush assemblies. For example, U.S. Pat. No. 4,098,546, issued to the Applicant's assignee, discloses a full rotational freedom, substantially zero friction electrical conductor assembly for conducting electrical currents between relatively rotatable members of sensitive instruments such as gyroscopic devices and the like. Each electrical transfer unit of the assembly comprises a pair of coaxial, concentric, coplanar continuous, concave conductor rings, one mounted on a relatively fixed member and the other mounted on a rotatable member, the relative diameters of the rings providing a substantial annular radial gap therebetween. A resilient electrically conducting continuous filamentary loop is disposed in the radial gap such that its generally flat outside surface contacts and rolls on the concave surface of the conductor rings. The loop or conductor interface provides self-capturing and retaining forces to accommodate any misalignment between the rings and movements of the loops within the radial gap in a vibratory environment, all without producing frictional torques on the rotatable member.

In high power applications a major disadvantage of the above described apparatus is that all the electric current to be conducted from one ring to the other must pass through only a single conductor loop. Clearly the current carrying capacity of that assembly is limited to that of the conductor loop whose cross section dimensions are constrained to satisfy the physical requirements of the rolling ring contact principles. Although one could simply add more conductive loops evenly spaced from one another in the radial gap to increase the current carrying capacity and in theory they would maintain their spaced relationship, in practice, however, mechanical perfection is not possible and tolerances exist which cause the rings eventually to contact one another causing friction and thereby defeating the basic advantage of roll ring contacts as taught in the patent number 4,098,546. Thus there is a need to provide industry, such as the aerospace industry, with a solution to the problem of transferring relatively high electrical current between stator and rotor members while utilizing the substantially zero friction roll ring technology. The present invention provides a roll ring contact assembly which retains the substantially zero friction advantage yet allows very high currents to be conducted between the stator and rotor of the device.

SUMMARY OF THE INVENTION

The present invention provides an electrical conductor assembly having the usual stator and rotor members relatively rotatable about a common axis and having at least one pair of coplanar conductive rings, one mounted on the stator member and the other mounted on the rotor member, the relative diameters of the rings providing a substantial annular radial gap therebetween. A plurality of resilient filamentary conductive loops with a free diameter greater than the width of the annular radial gap are disposed within the gap and contact and roll on the juxtaposed surfaces of the electrical conductive rings. Flanged spools are interspaced between adjacent conductive loops in rolling contact therewith to prevent the loops from touching one another and producing sliding friction. A raceway concentric with the conducting rings is affixed to the rotor and provides a rolling track for the flanged rollers. Unlike the prior art electrical conductor assemblies which have only one conductive loop in the annular gap, the present invention has a plurality of radially spaced conductive loops and flanged spools which serve as loop separators. Thus the present invention can handle greatly increased electrical currents required for power circuits while retaining the substantially zero friction roll ring technology. For a more detailed understanding of the present invention in its preferred embodiment, reference is made to the following description and accompanying drawings.

DESCRIPTION OF THE PREFERRED EMBODIMENT

Figure 1:
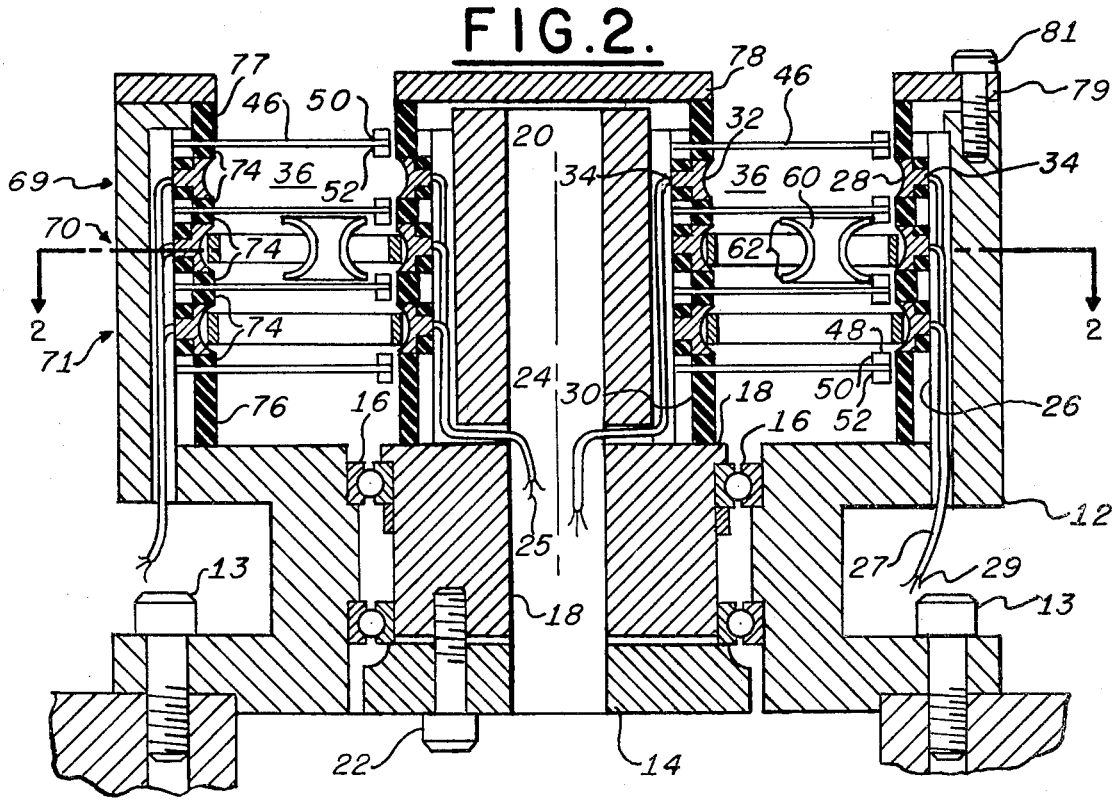
FIG. 1 is a sectional view of the electrical conductor assembly of the present invention taken on line 1—1 of FIG. 2.

Referring to FIG. 1 of the drawings, the present invention is shown in conjunction with a relatively stationary member 10 and a relatively rotatable member 14 as might be found, for example, in a space vehicle, such as between spun and despun structures of satellites and pointing systems of solar panels or antennas. It will be understood, of course, that the invention is also applicable in structures such as electric motors or gyroscopes or other rotary equipment. In the presently preferred embodiment a stationary housing 12 is attached to stationary member 10 as with bolts 13. The stationary housing 12 supports a rotor 18 in precision ball bearings 16. Rotor 18 is mounted on the rotatable member 14 for rotation about the common axis 20, and is secured to the member 14 by suitable means such as mounting bolts 22. The rotor 18 is cylindrical and includes passageways 24 for electrical leads 25 from the electrical conductor assembly of the invention to the electrical apparatus carried on the rotatable assembly associated with member 14, not shown. Similarly, the stationary housing 12 includes passageways 27 for electrical leads 29 from the conductor assembly of the invention to the relatively stationary apparatus, not shown. Evenly and axially distributed along the inner surface 26 of the stationary housing 12 are a plurality of circular, concave-faced, electrically conductive rings 28, hereinafter referred to as the outer conductor rings 28. Evenly distributed along the outer surface 30 of the rotor 18 are similar sets of circular, concave-faced, electrically conductive rings 32, hereinafter referred to as the inner conductor rings 32. The inner rings 32 are arranged with respect to the outer rings 28 to form coaxial, coplanar pairs. Each inner and outer conductor ring 32 and 28 is electrically connected to a corresponding electrical terminal 34 for providing circuit connections to the electrical leads 25 and 29.

Figure 2:
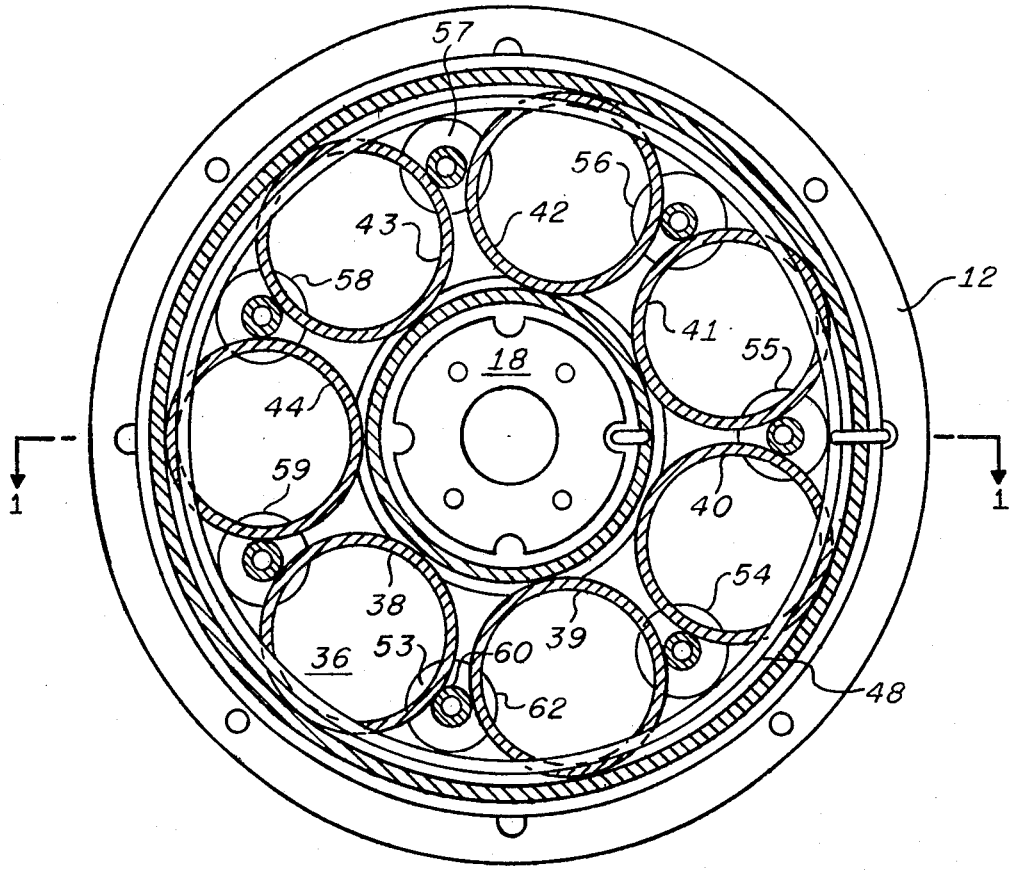
FIG. 2 is an end view of the assembly of FIG. 1 with its protective covers removed.

The radial dimensions of the inner rings 28 and outer rings 32 define a substantial annular radial gap 36 therebetween. Within the annular radial gap 36 are located a plurality of resilient, filamentary, conductor loops 38, 39, 40, 41, 42, 43 and 44, arranged in radially spaced, coplanar fashion about common axis 20 in rolling contact with corresponding pairs of inner and outer conductor rings 28 and 32, as shown in FIG. 2. It should be understood that while FIG. 2 shows seven conductor loops, 38–44, disposed within the radial gap 36, other quantities of loops may be chosen without departing from the spirit of this invention. The contact interfaces between the conductor rings and the filamentary conductor loops are the same or substantially the same as taught in the referenced patent whereby the loops are self-captured and self-aligned between the rings. That is, the conductor loops have substantially flat exterior surfaces; the outer edges thereof contact the relatively shallow arcuate concave surfaces of the pairs of rings along varying lines of contact dependent upon any limited axial, radial, and angular misalignments between the rings; whereby compressive forces between the loops and concave surfaces produce capturing and aligning forces on the loops. It will be appreciated that the loop edges need not be and preferably are not, sharp. They may be rounded to some extent to provide increased area contact. As shown in FIG. 1, the sets of paired conductor rings and cooperative coplanar loops are axially stacked in spaced relation, each set electrically connected to its own electrical terminals to provide multiple circuit capability. The number of sets is, of course, variable dependent upon a specific application. In practice the sets of paired conductor rings and cooperative coplanar loops generally described above may be built up from separate components to form conductor modular assemblies, shown generally as 69, 70 and 71 in FIG. 1. These modular assemblies are electrically insulated from one another by complementary pairs of inner and outer annular insulating wafers 74. The modular assemblies 69, 70 and 71 and the corresponding insulating wafers 74 are sandwiched together and clamped between a first and a second pair of annular retainers 76 and 77. Clamping pressure is provided by suitable means, as with a circular cap 78 fastened to the rotor 18 with bolts 80, and with an annular cap 79 attached to the stationary housing 12 with bolts 81.

In the presently preferred embodiment flat, circular, non-conductive discs 46 are disposed about and between the modular assemblies, substantially spanning the annular radial gap 36, and are clamped or otherwise attached to the rotor 18 for rotation therewith. Thus the discs 46, in addition to their primary function, to be described, also serve to separate and insulate the axially stacked modular assemblies. A rim 48 is carried on the outer circumference of the disc 46, forming a first perpendicular shoulder 50 with respect to one face of the disc, and forming a second perpendicular shoulder 52 with respect to the other face of the disc. Flanged, preferably electrically conductive, loop-separating rollers on spools 53, 54, 55, 56, 57, 58 and 59 having a concave waist portion 60 and flanged rims 62, as shown in FIG. 1, are radially interspaced between adjacent pairs of conductor loops as shown in FIG. 2. The spools are disposed within the annular gap 36 between adjacent discs 46 and are generally coplanar with the adjacent pairs of conductor loops. The flanged rims 62 of each spool are held in rolling contact with the rims 48 of discs 46 while the waist 60 of each spool is held in rolling contact with its adjacent pair of conductor loops. The relative radii of the spools' waist 60 and flanged rims 62 and of the retaining rim 48 and conductor loops are selected so that the spools are captured by and held in rolling contact with the retaining rim and conductor loops, as will be described more fully below.

In order to achieve the desired loop-ring contact without substantial buckling and the desired substantially frictionless rolling contact between the flanged rim 62 of the loop separating spool and the retaining rim 48, while simultaneously achieving the desired rolling contact between the waist 60 of the loop separating spool and the conductor loops, a number of interrelated parameters must be considered. Generally the gap radial dimension ($R_O - R_I$) wherein $R_O$ is the radius of the outer ring and $R_I$ is the radius of the inner ring, and the loop radius $R_F$ are preordained by the desired basic roll ring contact assembly dimensions. Typically the dimensions $R_O$ and $R_I$ are dictated by the size and space constraints of a particular application and it is noted that a wide selection of parameters are available depending upon the environmental requirements. The conductor loop radius $R_F$ is selected in accordance with the established principles of the roll ring art as taught in U.S. Pat. No. 4,098,546. Having selected the gap radial dimension ($R_O - R_I$) and the radius of the conductive loop $R_F$, a plurality of conductor loops are evenly arranged radially within the radial gap. Usually the number of loops arranged is the maximum number which will fit within the radial gap without touching one another, hereinafter referred to as the number n. In the one embodiment shown in FIG. 2, the maximum number of loops happens to be seven wherein the loops have an angular separation $\alpha$ of approximately 51.43°, wherein $\alpha = 360°/n$. Of course, other applications and geometries may require a different number of loops. Although not critical, the outer dimensions of the disc 46 is selected so that once clamped in place, it may rotate freely without touching the stationary housing 12. The retaining rim 48, depending on its thickness and the material used, defines along its inner shoulders a raceway of radius $R_W$ for rolling travel of the loop separating spools.

Having thus selected appropriate values for $R_I$, $R_O$, $R_W$, and $\alpha$, the following formulas are used to compute the additional parameters needed to practice the invention, namely, $R_R$, the radius of the waist 60 of a spool and its point of contact with the conductor loop, and $R_A$, the radius of the flanged rim 62 of a spool at its point of contact with the retaining rim 48.

$$R_R = -R_F + (R_I + R_F) \sin \theta / \cos (\beta - \theta)$$

$$R_A = +R_W - (R_I + R_F)\cos\beta/\cos(\beta - \theta)$$

wherein $$\theta = \alpha/2$$

$$\phi = \tan^{-1}\left[\frac{\sin\theta}{(\cos\theta - R_I/R_W)}\right]$$

$$\beta = \phi - \cos^{-1}\left\{\frac{\sin\theta}{[\sin^2\theta + (\cos\theta - R_I/R_W)^2]^{\frac{1}{2}}}\right\}$$

OPERATION

Figure 3:
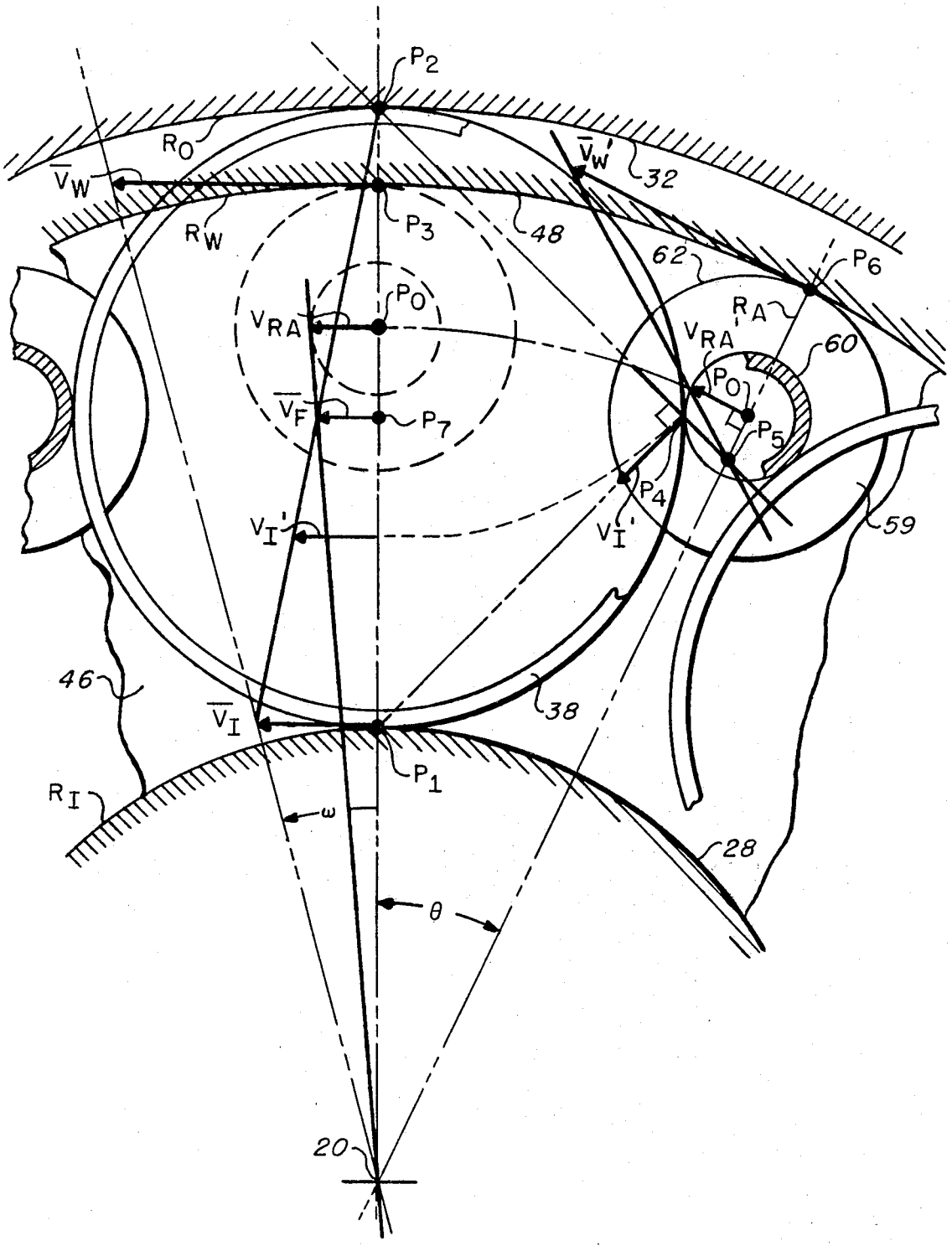
FIG. 3 is a diagram illustrating the generalized geometry of the loop ring interfaces.

As previously indicated, the relative geometries of the various loops, rings, and spool members are selected so that these members roll on one another, thus preventing sliding friction with its attendant drag, wear and possible polymer build-up. The rolling contact operation of the present invention is illustrated in FIG. 3 wherein the inner conductor ring 28 is assumed to rotate in a counterclockwise direction with an angular velocity $\omega$. Because the conductor loops are maintained in physical contact with the inner conductor ring 28 as loop 38 is shown in such contact at point $p_1$, the loops rotate with a clockwise angular velocity proportional to $\omega$. For no slipping or sliding friction to occur, it will be seen that the instantaneous velocity of a point on loop 38 at $p_1$ must equal the instantaneous velocity of a point on the inner conductor ring 28 at point $p_1$. This instantaneous velocity is shown as a vector $\overline{v}_I$ in FIG. 3. Similarly, since the loops are in non-sliding contact with the outer conductor ring 32 as loop 38 is shown in such contact at point $p_2$, and since ring 32 is stationary, these touching points must be instant centers of rotation for the loops. The velocity of the loop 38 at point $p_1$ is equal to $\overline{v}_I$ since the loop and inner ring do not slide with respect to each other. The velocity of the geometric center of loop 38, point $p_7$, is also proportional to $\overline{v}_I$ and may also be seen as a rotation about point $p_2$, shown as vector $\overline{v}_F$ whose tip touches a line drawn between point $p_2$ and the tip of vector $\overline{v}_I$. If there is to be no slipping or sliding friction between loop 38 and the waist 60 of the loop separating spool, then the instantaneous velocity of the waist at the point of contact $p_4$ must equal the instantaneous velocity of the loop at that point of contact. This instantaneous velocity, shown as vector $\overline{v}_I'$, may be seen as a rotation about point $p_2$ having a magnitude proportional to that of vector $\overline{v}_I$, see projection. Furthermore, there is to be no sliding between the spools and the rolling track defined by retaining rim 48. Thus the instantaneous velocity of the retaining rim 48 and the flanged rims 62 must be equal at the point of contact $p_6$.

That the instantaneous velocity of the loop 38 and of the waist portion 60 of each loop separating spool must be equal at their points of contact, point $p_4$, is apparent since the retaining rim 48 is carried by the disc 46 which is in turn clamped to the inner ring 28. The rim rotates with angular velocity $\omega$, and any point on the shoulder thereof, such as points $p_3$ and $p_6$ for instance, has an instantaneous velocity proportional to $\overline{v}_I$ as shown by vector $\overline{v}_W$. Thus, the waist portion 60 must, at point $p_4$, have an instantaneous velocity equal in magnitude to $\overline{v}_I'$. To see that such is the case with the present invention, one may recognize that a point on the waist 60 of the spool such as point $p_4$ undergoes a complex harmonic motion within the annular gap as it rotates generally about the common axis 20 in proportion with angular velocity $\omega$. This complex harmonic motion may be further described by identifying the point about which all other points upon the spool, including point $p_6$, seem to rotate as the spool orbits the common axis 20. This center of rotation relative to the common axis, as it has been called, may be located graphically, using a technique well known in mechanics, by selecting two spaced points on the spool, drawing their velocity vectors, and then constructing perpendiculars to those vectors. Where the perpendiculars intersect, is the center of rotation.

From the foregoing we know that the velocity at point $p_4$ on the spool is vector $\overline{v}_I'$. As a second reference point, one might select the velocity of the flanged rim, point $p_6$, whose instantaneous velocity, vector $\overline{v}_W'$, equal to $\overline{v}_W$, is seen as a rotation about the common axis 20. The center of rotation of the spool can then be located using the graphical technique described above. Lines perpendicular to the velocity vectors $\overline{v}_I'$ and $\overline{v}_W'$ are constructed and found to intersect at point $p_5$, the center of rotation.

The center of rotation, point $p_5$, having been found, one may regard the point at the center of the spool $p_0$ as rotating about this center of rotation $p_5$, with velocity $\overline{v}_{RA}'$, which is proportional to $\overline{v}_W'$.

Now that the true velocity of the spool center, $\overline{v}_{RA}'$, has been established, it remains to be shown that this velocity is compatible with the velocity of the center of the loop 38 so that the loop and the spool neither separate or attempt to pass each other as they rotate. This is shown by momentarily projecting the spool (dashed lines) to the position it will occupy when its center $p_0$ is rotated into linear alignment with point $p_7$ and the common axis 20, the instantaneous velocity $\overline{v}_{RA}$ will be seen as proportional in magnitude to the instantaneous velocity $\overline{v}_F$ of the center loop 38. It can further be seen that $\overline{v}_{RA}$ is exactly equal to $\overline{v}_{RA}'$, and thus no separation between loop and spool or sliding friction will occur.

Figure 4:
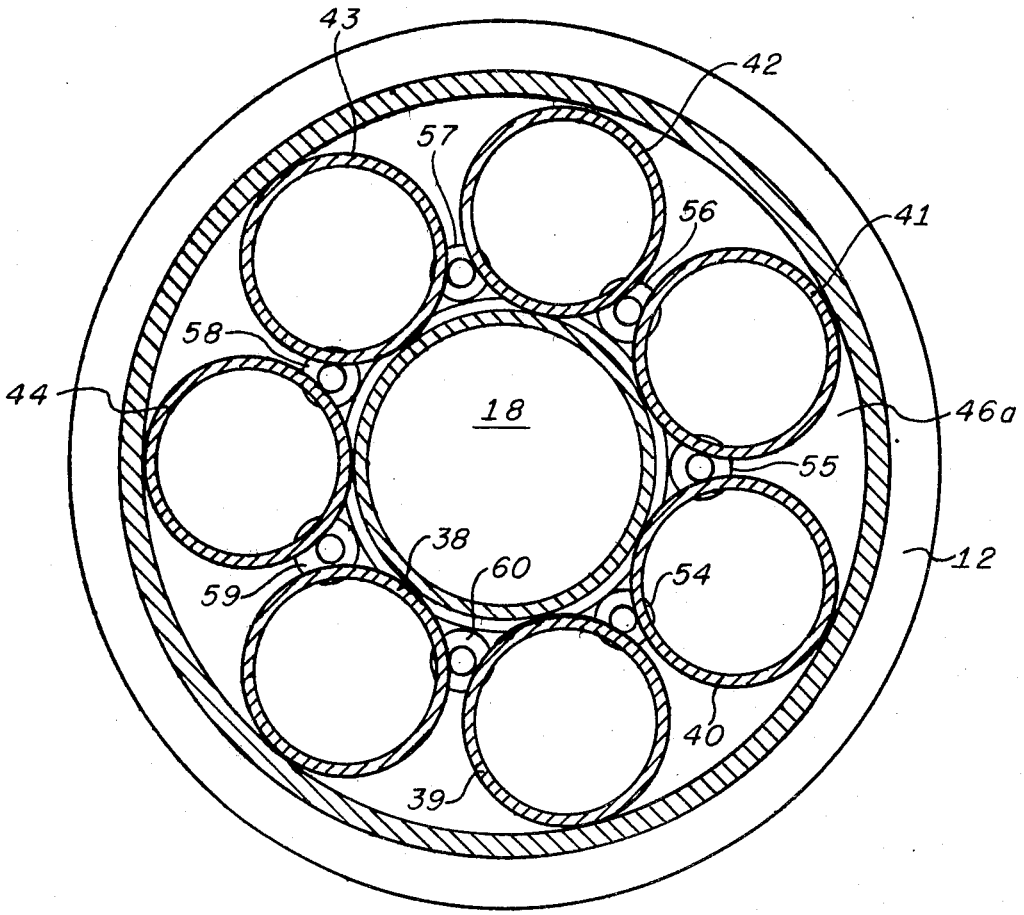
FIG. 4 is an end view of another embodiment of the invention, also shown with rolling track and protective covers removed.

While in the foregoing there has been described one particular embodiment of the present invention, it will be understood that other embodiments thereof may be made without departing from the scope and spirit of the invention. For example, referring to FIG. 4, the retaining rim 48 may be attached to the stationary housing 12 by suitable means such as a non-conductive washer or disc 46a in which case the loop separating rollers may be disposed within the annular gap between the loops so that their centers are a lesser radial distance from the common axis 20 than are the centers of the conductor loops.

While the invention has been described in its preferred embodiments, it is to be understood that the words which have been used are words of description rather than limitation and that changes may be made within the purview of the appended claims without departing from the true scope and spirit of the invention in its broader aspects.

We claim:

1. A full rotational freedom conductor assembly for conducting electrical energy between a pair of members relatively rotatable about a common axis thereof comprising (a) first and second circular, coplanar electrically conductive rings, one thereof being disposed on one of said members and the other thereof being disposed on the other said members, providing a relatively large radial gap therebetween;

(b) a plurality of resilient, filamentary, coplanar conductive circular loops disposed in said gap in rolling contact with said rings for providing electrical conductivity between said pair of rings;

(c) loop separating means disposed in rolling contact with said circular loops and arranged to prevent physical contact between adjacent circular loops;

(d) retaining means disposed on at least one of said members and in rolling contact with said loop separating means for holding said loop separating means in contact with said circular loops.

2. The conductor assembly as set forth in claim 1 wherein at least one of the facing surfaces of each of said pairs of rings have a concave configuration and wherein each of said circular conductive loops have a substantially flat exterior surface, the spaced outer edges thereof contacting said concave surfaces along varying lines of contact dependent upon any limited axial, radial, and angular misalignments between said rings, and wherein compressive forces between said loops and concave surfaces produce force components on said loops in directions such as to maintain said loops within said concave surfaces.

3. The conductor assembly as set forth in claim 1 wherein one ring of said pair of rings is electrically connected with a common electrical circuit associated with one of said members and the other ring of said pair of rings is electrically connected with a common electrical circuit associated with the other of said members whereby said conductive circular loops provide redundant electrical coupling between said relatively rotatable members.

4. A conductor assembly according to claim 1 further comprising third and fourth circular coplanar electrically conductive rings disposed in axial alignment with said first and second conductive rings, one of said third and fourth rings being disposed on one of said members and the other thereof being disposed on the other said members, providing a relatively large radial gap therebetween; a plurality of resilient filamentary coplanar conductive circular loops disposed in the gap between said third and fourth conductive rings, in rolling contact with said rings, for providing electrical conductivity between said third and fourth rings.

5. A conductor assembly according to claim 1 wherein said loop separating means is circular having a first circumference disposed in rolling contact with said circular loops, and having a second circumference disposed in rolling contact with said retaining means.

6. A conductor assembly according to claim 1 wherein said loop separating means is circular and has radially projecting rims of a first diameter disposed in rolling contact with said retaining means, and has a waist portion of a second, lesser, diameter disposed in rolling contact with said conductor loops.

7. A conductor assembly according to claim 1 wherein said retaining means includes a circular rim disposed in coaxial relation to said rings.

8. A conductor assembly according to claim 7 wherein said retaining means includes a radially extending, nonconductive wafer disposed on one of said members and attached to said circular rim for carrying said rim.

9. An improved conductor assembly for conducting electrical energy between a pair of members relatively rotatable about a common axis thereof having first and second circular, coplanar electrically conductive rings disposed respectively on said members, the respective diameters of said rings defining therebetween a radial gap, wherein the improvement comprises:

(a) a plurality of resilient, filamentary, coplanar conductive circular loops disposed in said gap in rolling contact with said rings for providing electrical conductivity between said pair of rings;

(b) loop separating means disposed in rolling contact with said circular loops and arranged to prevent physical contact between adjacent circular loops;

(c) retaining means disposed on at least one of said members and in rolling contact with said loop separating means for holding said loop separating means in contact with said circular loops.

10. A conductor assembly according to claim 9 wherein said loop separating means is circular having a first circumference disposed in rolling contact with said circular loops, and having a second circumference disposed in rolling contact with said retaining means.

11. A conductor assembly according to claim 9 wherein said loop separating means is circular and has radially projecting rims of a first diameter disposed in rolling contact with said retaining means, and has a waist portion of a second, lesser, diameter disposed in rolling contact with said conductor loops.

12. A conductor assembly according to claim 9 wherein said retaining means includes a circular rim disposed in coaxial relation to said rings.

13. A conductor assembly according to claim 12 wherein said retaining means includes a radially extending, nonconductive wafer disposed on one of said members and attached to said circular rim for carrying said rim.

* * * * *